US005271537A

United States Patent [19]

Johnson

[11] Patent Number: 5,271,537

[45] Date of Patent: Dec. 21, 1993

[54] FOAM DISPENSING DEVICE

[76] Inventor: Charles W. Johnson, 256 Blantyre Avenue, Scarborough, Ontario, Canada, M1N 2S1

[21] Appl. No.: 929,416

[22] Filed: Aug. 14, 1992

[51] Int. Cl.[5] ..... B67D 5/06

[52] U.S. Cl. ..... 222/509; 222/518

[58] Field of Search ..... 222/402.1, 402.25, 325, 222/501, 518, 509; 239/375, 525, 526

[56] References Cited

U.S. PATENT DOCUMENTS

| | | | |
|---|---|---|---|
| 670,509 | 3/1901 | Erwin | 222/518 |
| 1,380,973 | 6/1921 | Kelsea | 222/518 |
| 2,523,084 | 9/1950 | Adragna | 239/526 |
| 2,656,217 | 10/1953 | Roche | 239/375 |
| 2,887,272 | 5/1959 | Rosenthal | 222/402.25 |
| 3,096,001 | 7/1963 | Boe et al. | 222/518 |
| 4,120,431 | 10/1978 | Schultz | 222/518 |
| 4,496,081 | 1/1985 | Farrey | 222/135 |
| 4,959,159 | 9/1990 | Mattson | 239/526 |

FOREIGN PATENT DOCUMENTS 653574 6/1915 Switzerland .

OTHER PUBLICATIONS

Pageris Brochure, 3 pages no date.

3 Photographs, one of P.C. O gun, one of fomo gun, one of Pageris gun Foma Brochure, 6 pages, (no date).

*Primary Examiner*—Andres Kashnikow
*Assistant Examiner*—Philippe Derakshani

[57] ABSTRACT

A dispenser device for products contained in a container under pressure, and having, a dispenser body, a handle connected to the dispenser body, an axial recess extending along the body, and having a forward end and a rearward end, a container support formed on the body, and an opening extending from the container support to the axial recess, a dispenser nozzle extending forwardly from the forward end of the body, and having a dispenser opening and an interior valve seat and a dispensing conduit extending axially, a valve member moveable into an out of engagement with the valve seat, a valve operating rod extending along the axial conduit, and through the recess in the body, the material being able to flow along the axial recess and the axial conduit around the operating rod, and a rear opening at the rearward end of the body with and a seal, an extension of the valve operating rod extending rearwardly through the rear opening, a handle opening in the handle, a connection extending from the rearward extension of the valve operating rod through the handle opening so that an operator can procure rearward movement of the valve member to open the dispenser opening.

5 Claims, 1 Drawing Sheet

C
28
26
20
42
46
50
48
14
52
12
54
32
30
10
56
58
18
22
16
36
25
24
34
40
44

FOAM DISPENSING DEVICE

FIELD OF THE INVENTION

The invention relates to dispensing devices, known in the trade as dispensing "guns" such as are used for dispensing pressurized materials such as insulation foam, adhesives, grouts, and the like, onto or into a work piece.

BACKGROUND OF THE INVENTION

Various materials are used, particularly in construction, such as insulation foams, and adhesives, and grouts, which are dispensed from containers under pressure. Typically, the container will be pre-filled with the material, together with an inert gas, which is pressurized. The container has a manually operable valve. When the valve is open the pressure of the gas forces the material out of the container. As mentioned, such materials are widely used for insulation. Typically such insulation materials will be of the group known as polyurethane foam. However, other such materials are also packaged and dispensed from similar containers, for example joint filling compounds or grouts, adhesives and the like.

In the past, many of these materials have been packaged somewhat crudely in manually operable cartridges. The cartridge was simply a cylindrical sleeve of cardboard, with a nozzle at one end and a simple sheet metal piston at the other. Such cartridges could be placed in a manually operable dispensing device. The nozzle end was then cut off, and by means of a handle, a rod, and a lever the piston was forced along the cylindrical cartridge, thereby ejecting the material through the dispensing nozzle. However, these systems require very substantial manual effort in the lever. In addition the cartridges only contained a relatively small volume of material, and consequently they had to be replaced repeatedly. As a result, the packaging alone in such cartridges represents a substantial cost of the end product.

A further and more serious disadvantage is that the pressure with which the product is dispensed, depends essentially on the manual strength of the operator. Obviously a stronger man with a large hand can apply more pressure to the lever, than a man with less strength.

There is however a still further disadvantage. The force with which the material is ejected, on any given ejection stroke may vary, during the stroke, depending upon how steadily the manual pressure is applied and the mechanical advantage of the lever. In addition, the force applied to the stroke may vary from one stroke to another even by the same operator.

Consequently, there is a continual problem when using this type of manual dispensing cartridge, in that the "bead" of material being dispensed will vary in thickness and depth, from one stroke to another and even during the same stroke.

A further problem is that it is usually desired to apply a continuous "bead". However in the manual dispenser the lever had to be released and pressed repeatedly, causing intermittent pressure drops, with even the most skilled of operators.

Accordingly, in order to overcome a number of these problems, pressurized packages have been developed, in which the material to be dispensed is contained in a pressurized container which also contains a pressure medium such as an inert gas under pressure. Manually operable valves on such containers permit the material to be dispensed as desired. In such containers, since the pressure is dependent upon the pressure of the inert gas or medium, the ejection pressure is more or less constant so long as there is any material and gas left in the container.

However, the containers themselves have proved relatively inconvenient to use. The valve on such a container is usually a relatively small device at one end of the container. Consequently, in many cases it is not possible to apply the valve directly to the work piece, and some material becomes dispensed where it is not required and is wasted.

Accordingly, there have been developed by a number of companies a form of dispensing device or gun for use with such pressurized cartridges. Typically these guns will incorporate an elongated slender dispensing nozzle, and a cartridge mounting upon which the pressurized cartridge holding the material may be attached. Within the dispensing nozzle, a dispensing valve is provided. A manually operable trigger is provided on the dispensing gun. The trigger is connected to the valve, so that by operation of the trigger the valve can be opened thereby permitting the material to be dispensed through the nozzle onto the work piece. Such guns have achieved wide popularity since they enable a workman to dispense the material directly into the precise location required on the work piece with little or no wastage.

The pressure is both constant, independent of the operator strength, and continuous, so long as the trigger is pressed. The majority of such dispensers or guns on the market all have the same basic design features. However, in all of them, the actual construction of the dispensing gun requires the manufacture and assembly of a large number of parts, all of which must be made to careful tolerances, and which must be assembled by skilled workmen. Internal seals are provided where necessary to prevent the material under pressure from entering portions of the gun where it is not required.

Usually, the manufacturers of the materials, or the manufacturer of the gun, or both will supply a solvent type of cleaner which is forced through the gun at the end of the days work, to clean it.

Unless this cleansing operation is performed immediately after use, the material will cure within the body of the gun, and the gun will then be rendered useless. This in fact is what occurs, not infrequently. Bearing in mind the high cost of these dispenser guns, it will be appreciated that this can cause problems for a small contractor. Another disadvantage of these relatively complex sophisticated dispensing guns is that their high cost tends to limit the actual sales of the material itself. There may be many handymen, and do-it-yourself householders, who would wish to use such pressurised materials for sealing cracks, or for grouting, or closing spaces around window and door openings, so as to improve the insulation and weather proof characteristics of a home. However, the cost of the dispensing gun itself represents a relatively substantial investment to such persons. Accordingly, unless they are prepared to make this investment, it may well be that they will simply not buy the pressurised material at all. It will thus be appreciated that to some considerable extent the sales of such materials are limited to professional insulation and construction firms. The small handyman and the home owner market have remained virtually closed to this type of material. Clearly, it would be desirable to provide a low cost dispensing gun for use with these pressurized materials. If a dispenser could be produced at a low enough cost that it could be virtually used for one day and then discarded, it would enable a home handyman or home owner to buy a few containers of the material, and a dispenser and do a day's work, an then simply throw away the empty containers, and also the dispenser itself.

For the sake of economy, the dispenser should preferably be of such a design that it consists of only two or three separate parts. However, it is also desirable that it can easily be taken apart and washed out with solvent, so that it can be reused several times before it is discarded, if desired.

BRIEF SUMMARY OF THE INVENTION

With a view to satisfying the various foregoing objectives, the invention will be seen to comprise a dispenser device for products contained in a container under pressure, and comprising, a dispenser body portion, handle means connected to said dispenser body portion, an axial recess extending along said body portion, and defining a forward end and a rearward end, container support means formed on said body portion, and opening means extending from said container support means to said axial recess, dispenser nozzle means extending forwardly from said forward end of said body means, and defining interior valve seat means therein, of a predetermined first diameter, and a dispensing conduit extending axially thereof, of a predetermined second diameter greater than said first diameter, a valve member moveable into an out of engagement with said valve seat means, a valve operating rod extending along said axial conduit, and through said axial recess in said body member, said material being adapted to flow along said axial recess and said axial conduit around said operating member, and opening means at the rearward end of said body member, and sealing means located therearound, an extension portion of said valve operating member extending rearwardly through said opening means, and said sealing means, handle opening means in said handle means, connection means extending from said rearward extension of said valve operating means through said handle opening means, whereby operation of said connection means will procure rearward movement of said valve operating means, and, means biasing said valve operating means forwardly, whereby to maintain said valve member normally closed on said valve seat.

The invention further comprises such a dispensing device, and wherein said valve member, said valve operating means, and said connection means are all formed integrally out of a single piece of metal, and wherein said connection means comprises a generally U shaped bend portion formed in the rearward end in said rearward end extension of said valve operating means.

The invention further comprises such a dispensing device and wherein said dispensing nozzle comprises an elongated generally tubular member, having a forward end and a rearward end, and at said rearward end, there being threaded means interengageable with complimentary threading means at said forward end of said body portion, whereby the same may be releasably attachable to said body member.

The invention further comprises such a dispensing device and wherein said trigger means incorporates a trigger button member attachable to said connection means forwardly of said handle, and being releasably detachable therefrom.

The invention further comprises such a dispensing device and wherein said biassing means comprises spring means within said axial recess of said body member, and abutment means releasably interengageable with said valve operating member, whereby to maintain said spring in compression between said abutment means and said rearward end of said body member.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figures 1, 2, 3:
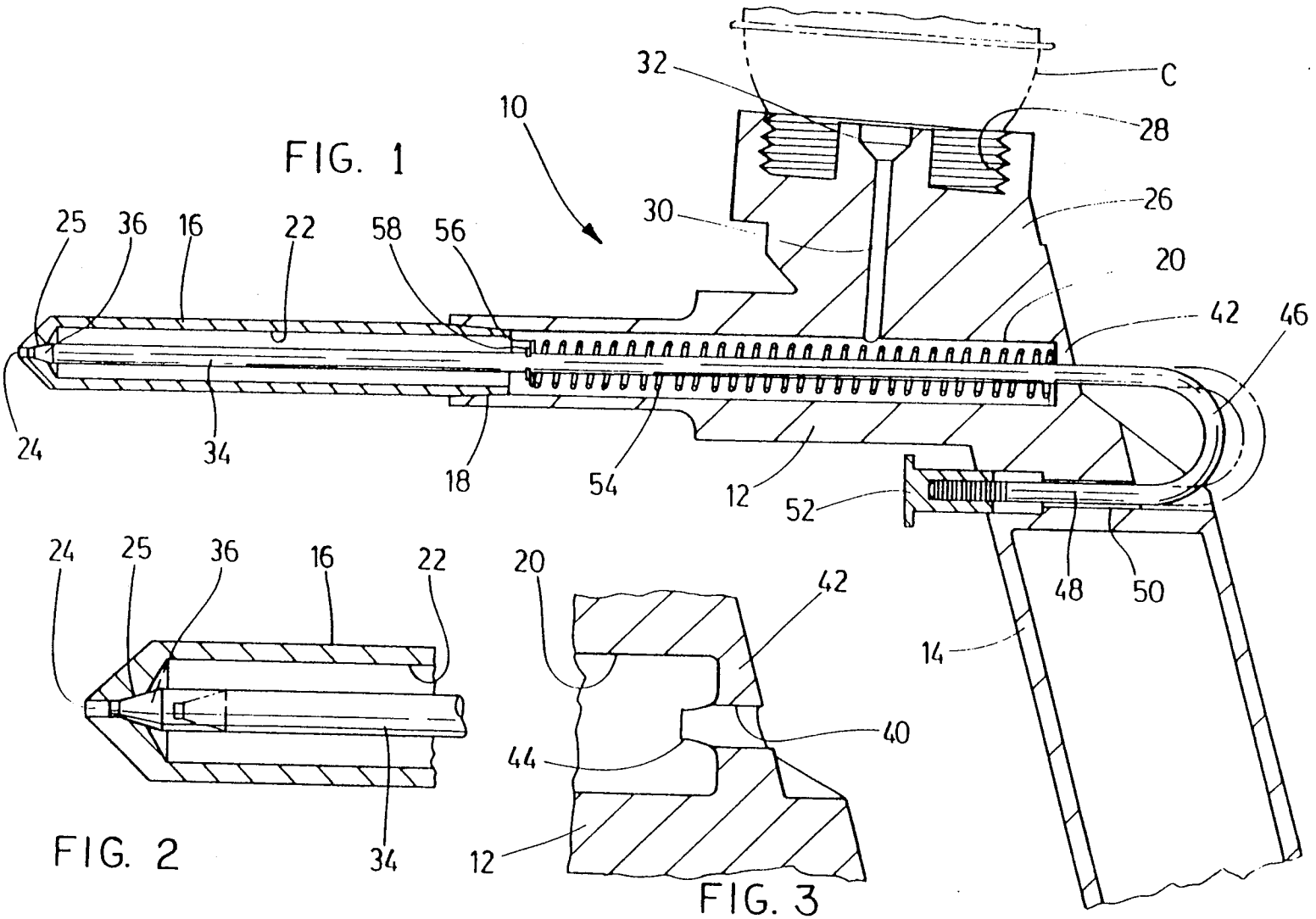
FIG. 1 is a perspective illustration of a typical dispensing device in accordance with the invention.
FIG. 2 is an enlargened section along the line 2—2 of FIG. 1, with movement shown in phantom; and, FIG. 3 is an enlarged section of the dispensing device of FIGS. 1 and 2, shortened for clarification.

Referring first of all to FIG. 1, it will be seen that the invention comprises a dispensing device indicated generally as 10. Such a dispensing device has the general appearance of a hand gun. A container C is shown in phantom.

Such containers may contain any of a variety of materials under pressure In many cases such materials will be foam insulation materials such as polyurethane based materials, and they may be pressurized by any one of a variety of inert gases. All this is well known in the art and requires no description. however, the invention is not limited to insulation materials as such, but incorporates a variety of other materials for example such as types of adhesives, grouts, crack fillers, and the like, which it may be desired to dispense by using such equipment.

In the great majority of cases such materials find their most frequent applications in the construction industry. Either in new construction, or in renovation projects, there will be many situations where it is desirable to dispense insulation material, adhesives, grouts, crack fillers, and the like into confined spaces.

Referring generally to FIG. 1, the dispensing device 10 will be seen to comprise a body portion 12, handle portion 14, and a dispensing nozzle 16.

The body portion 12 is of generally elongated cylindrical shape, and the handle portion 14 is formed integrally therewith of generally hollow construction. Thus the parts can be and preferably, but not essentially, are moulded in one piece from thermo-plastic material.

In this embodiment of the invention the nozzle 16 is formed as a separate preferably injection moulded, part.

The nozzle 16 screws into the main body 12, at the threaded junction 18.

Body 12 defines an elongated interior axial cavity or recess 20, and nozzle 16 defines an elongated interior axial conduit or recess 22. Recess 20 has a predetermined first size, and recess 22 has a predetermined second size, with recess 20 being somewhat larger than recess 22.

The free end of nozzle 16 defines an ejection opening 24, of a suitable size for ejection of a bead of the material to be dispensed from the dispenser. If different materials of different consistencies or of different bead widths are to be dispensed, then nozzles 22 having different sized openings 24 could be provided as-part of a kit. A frusto conical valve seat 25 is formed around opening 24.

Material to be dispensed, is typically contained in a container shown in phantom as C. It is mounted on a container support portion 26, which in this case, although not essentially, is moulded integrally with body 12. Clearly support portion 26 could if desired be moulded separately and could be attached by any suitable means to body 12, although for reasons of economy, the illustrated form of construction is believed to be preferred in most cases.

The container C is of such a design that it has a male threaded fitting (not shown) at its end, and has a central valve (not shown) typically simply operated by finger pressure.

The container support 26 has a female threaded recess 8, to receive the male threaded end of the container C.

A conduit 30 is formed through support 26, connecting with the axial conduit 20 in body 12. At the upper or free end of the conduit 30, there is provided an enlarged valve recess, 32 for receiving the typical valve (not shown) on such pressurized container C.

It will thus be seen that when the container C is inverted (FIG. 1) and its male threaded end inserted into the female threaded recess 28 of the support 26, the container valve (not shown). will be received in the valve recess 32. As the container is screwed further into the recess 28, the valve will be depressed, thereby opening the container C and releasing its contents down conduit 30 into conduit or recess 20.

Within conduit 20, and conduit 22, there is provided a valve operating rod 34 which in this embodiment is preferably for reasons of economy formed of cylindrical metal material, although other shapes or materials could be used in certain cases. At its forward (left hand) end as illustrated in FIG. 1, it is provided with a frustoconical valve tip 36 adapted to seat in valve seat 25 around ejection opening 24 of nozzle 16, thereby preventing escape of material.

The rearward (right hand, as illustrated in FIG. 1) end of the rod 34 extends through an opening 40, in the end wall 42 of the conduit 20.

A sealing lip 44 (FIG. 3) is formed integrally with the end wall 42 around the opening 40.

The lip 44 is moulded with a certain degree of inherent resilience so that it squeezes the rod 34, and effectively provides adequate sealing at least over the useful life of the product.

The connection portion 46 is in fact merely an integral extension of the rod 34 in this embodiment, although of course it could be made separately if desired. It will be seen to be in this case of generally U-shape in side elevation, and comprises a lower forward portion 48. An operating recess 50 is formed through the upper end of handle 14, so as to permit the forward portion 48 to extend through the handle 40, and extend a short distance in front thereof.

A manually operable button 52 is screw threaded onto the forward end of portion 48.

In order to urge the rod 34 into its forward closed position, a spring 54 is located around rod 34, within conduit 20 of body 12.

The spring 54 at the rearward end of the body 12, seats on the end wall 42 of conduit 20.

At its opposite end (left hand end) in FIG. 1, spring 54 is secured by means of a releasable locking means, in this case a washer 56 and circlip 58. Washer 56 and circlip 58 are located so that they are spaced rearwardly of the inward threaded end 18 of the nozzle 16. Thus material from container C is free to flow down conduit 30, along conduit 20 and into 22 of nozzle 16. So long as the valve 36 at the forward end of rod 34 remains seated in the opening 24, the material cannot escape.

However, by finger pressure on button 52, the rod 34 is drawn rearwardly (shown in phantom in FIGS. 1 and 2), thereby withdrawing the valve 36 from the opening 24, and permitting material to be ejected by the pressure existing in container C through the opening 24.

It will thus be seen that the invention provides a simple economical means of dispensing material from a container C, while exercising a substantial degree of control over the flow of such material, and providing a convenient elongated dispensing nozzle by means of which material can be deposited in various locations at a work site.

After use, if it is desired, the device can be flushed out simply by passing a solvent through the conduit 30 and conduits 20 and 22.

Additional cleansing can readily be performed by simply unscrewing the nozzle 16, and washing the device in solvent, if that should be desired.

The foregoing is a description of a preferred embodiment of the invention which is given here by way of example only. The invention is not to be taken as limited to any of the specific features as described, but comprehends all such variations thereof as come within the scope of the appended claims.

I claim:

1. A dispenser device for dispensing products contained in a container under pressure, and comprising;

a dispenser body portion having forward and rear ends;

handle means connected to said dispenser body portion;

an axial recess extending along said body portion, and defining a forward end and a rearward end of a predetermined first size;

container support means formed on said body portion, and opening means extending from said container support means to said axial recess;

dispenser nozzle means extending forwardly from said forward end of said body portion, and defining a dispensing orifice and interior valve seat means therearound;

a dispensing conduit extending axially within said nozzle means, of a predetermined second size smaller than said axial recess;

a valve member moveable forwardly and rearwardly into and out of engagement with said valve seat means;

a valve operating rod extending from said valve member along said dispensing conduit, and through said axial recess in said body portion, said material being adapted to flow along said axial recess and said along said dispensing conduit around said operating rod;

opening means at the rearward end of said body portion, and sealing means located therearound;

an extension portion of said valve operating rod extending rearwardly through said opening means and through said sealing means;

handle opening means in said handle means;

connection means extending from said rearward extension of said valve operating rod through said handle opening means, whereby operation of said connection means will procure rearward movement of said valve operating rod, and, said valve operating rod, and said connection means being formed integrally out of a single piece of metal, and said connection means being a generally U shaped bend portion formed in the rearward end of the extension portion of said valve operating rod, and, means biasing said valve operating rod forwardly, whereby to maintain said valve member normally closed on said valve seat means.

2. A dispensing device as claimed in claim 1 and wherein said dispenser nozzle means comprises an elongated generally tubular member, having a forward end and a rearward end, and at said rearward end, there being threaded means interengageable with complimentary threading means at said forward end of said body portion, whereby the same may be releasably attachable to said body portion.

3. A dispensing device as claimed in claim 1 and including a button member attachable to said connection means forwardly of said handle means, and being detachable therefrom.

4. A dispensing device as claimed in claim 1 and wherein said biassing means comprises spring means within said axial recess of said body portion, and lacking means releasably mounted on said valve operating rod, whereby to maintain said spring in compression between said lacking means and said rearward end of said body portion, and defining a spacing between said nozzle means, and said lacking means.

5. A dispenser as claimed in claim 1 and wherein said U-shaped extension defines a return portion extending forwardly through said handle opening means, and finger engagement means on said free end of said return portion.

* * * * *